US011455920B2

(12) United States Patent
Zhang et al.

(10) Patent No.: US 11,455,920 B2
(45) Date of Patent: Sep. 27, 2022

(54) FLOOR TILE SCREEN

(71) Applicant: SHENZHEN GLOSHINE TECHNOLOGY CO., LTD., Guangdong (CN)

(72) Inventors: Xianfeng Zhang, Guangdong (CN); Yongjun Zhang, Guangdong (CN); Guoqiang Li, Guangdong (CN); Zhiqiang Gao, Guangdong (CN)

(73) Assignee: SHENZHEN GLOSHINE TECHNOLOGY CO., LTD., Shenzhen (CN)

( * ) Notice: Subject to any disclaimer, the term of this patent is extended or adjusted under 35 U.S.C. 154(b) by 826 days.

(21) Appl. No.: 16/344,542

(22) PCT Filed: Mar. 14, 2019

(86) PCT No.: PCT/CN2019/078128

§ 371 (c)(1),
(2) Date: Apr. 24, 2019

(87) PCT Pub. No.: WO2020/181551

PCT Pub. Date: Sep. 17, 2020

(65) Prior Publication Data

US 2021/0358349 A1 Nov. 18, 2021

(51) Int. Cl.

| | |
|---|---|
| ***G09F 19/22*** | (2006.01) |
| ***G09F 13/04*** | (2006.01) |
| *E04F 15/00* | (2006.01) |

(52) U.S. Cl.

CPC ..... *G09F 19/22* (2013.01); *G09F 13/0495* (2021.05); *E04F 15/00* (2013.01); *G09F 2019/223* (2013.01)

(58) Field of Classification Search

CPC ..... G09F 19/22; G09F 13/0495; G09F 2019/223; E04F 15/00

See application file for complete search history.

(56) References Cited

U.S. PATENT DOCUMENTS

| | | | | |
|---|---|---|---|---|
| 2005/0116667 | A1* | 6/2005 | Mueller | E04F 15/02 315/312 |
| 2009/0103280 | A1* | 4/2009 | Peard | E04B 5/46 362/97.1 |
| 2010/0238365 | A1* | 9/2010 | Hisakawa | G09F 9/35 361/679.01 |

FOREIGN PATENT DOCUMENTS

| | | |
|---|---|---|
| CN | 203113889 U | 8/2013 |
| CN | 206159232 U | 5/2017 |

* cited by examiner

*Primary Examiner* — Gary C Hoge

(57) ABSTRACT

The application provides a floor tile screen, comprising a box body (1), a rear body (2), a PCB board (3) and a front body (4), wherein the rear body (2) is fixed on the box body (1); the PCB (3) is arranged between the rear body (2) and the front body (4), and provided with lamp beads; a plurality of transparent fixing columns (41) are fixedly arranged on the front body (4), pass through the PCB board (3), fixedly connected with the rear body (2), and avoid the lamp beads. The fixing column (41) has the function of limiting the front body (4), the front body (4) and the rear body (2) are connected together by fixing columns (41), to avoid separation; the fixing columns (41) are transparent, so that the light emitted by the lamp beads is not blocked, the display effect of the floor tile screen is improved.

15 Claims, 2 Drawing Sheets

FLOOR TILE SCREEN

TECHNICAL FIELD OF THE INVENTION

The application relates to the technical field of display screens, in particular to a floor tile screen.

BACKGROUND OF THE INVENTION

Floor tile screens have the advantages of flexible installation, good load-bearing performance, easy maintenance, high contrast, uniform gray scale and good consistency, and are widely used in places or occasions such as stages, runways, exhibition stands, bars, nightclubs, broadcasting halls, conference rooms, multimedia classrooms, etc.

Floor tile screen is a kind of display screen laid on the floor, which can display the desired image more clearly and accurately. However, the floor tile screen in the market at present has a floor tile front body or tempered glass installed on the surface of the floor tile screen, and then the front body or tempered glass is fixed on the display screen by screws or bolts. When in use, there are blind corners where the screws or bolts are installed, which are displayed as black spots without images on the floor tile screen, seriously affecting the display effect of the floor tile screen.

Technical Problem

The technical problem to be solved by the application is to provide a floor tile screen, aiming at the problem of poor display effect of the floor tile screen in the prior art.

Technical Solutions

The technical scheme adopted by the application for solving the technical problems is as follows: A floor tile screen is provided, comprising a box body, a rear body, a PCB board and a front body, wherein the rear body is fixed on the box body, the PCB board is arranged between the rear body and the front body, the PCB board is provided with lamp beads. A plurality of transparent fixing columns are fixedly arranged on the front body, the fixing columns pass through the PCB board and are fixedly connected with the rear body, and the fixing columns avoid the lamp beads.

In the floor tile screen of the application, the fixing columns and the front body are integrally formed.

In the floor tile screen of the present application, one end of each of the plurality of fixing columns close to the front body is fixedly provided with limit blocks, the length of each of the plurality of limit blocks from one end close to the front body to one end far away from the front body is the same, and the limit blocks can abut against the PCB board or the rear body.

In the floor tile screen of the application, each fixing column is provided with a plurality of limit blocks, and the plurality of limit blocks are arranged at intervals along the circumferential direction of the fixing column.

In the floor tile screen of the application, a plurality of the fixing columns passing through the PCB board are uniformly distributed on the PCB board.

In the floor tile screen of the application, a plurality of transparent support columns are fixedly arranged on the rear body, the support columns pass through the PCB board and abut against the front body, and the support columns avoid the fixing columns.

In the floor tile screen of the application, further comprising a transparent board, wherein the board is fixed on the side of the front body facing away from the PCB board.

In the floor tile screen of the application, the transparent board is bonded to the front body.

In the floor tile screen of the application, further comprising a cover plate, wherein the cover plate is arranged between the front body and the PCB board, the cover plate is provided with a plurality of receiving holes, and the lamp beads are embedded in the receiving holes;

The cover plate is further provided with a plurality of through holes through which the fixing columns pass.

In the floor tile screen of the application, further comprising fixing pieces, wherein the rear body is provided with mounting holes, the fixing columns pass through the mounting holes, and the fixing pieces fix the fixing columns on the rear body.

In the floor tile screen of the application, the fixing columns are provided with fixing holes, and the fixing pieces can extend into the fixing holes and abut against the inner wall of the fixing holes.

In the floor tile screen of the application, positioning columns are fixedly arranged on the rear body, positioning holes are arranged on the box body, and the positioning columns can extend into the positioning holes.

In the floor tile screen of the application, further comprising a rear cover, a power supply and an adapter plate, wherein the rear cover is fixed on one side of the box body facing away from the rear body, the power supply is arranged in the rear cover, and the adapter plate is fixed in the rear cover and positioned between the power supply and the box body.

In the floor tile screen of the application, further comprising a first sealing ring, a second sealing ring and a third sealing ring, wherein the first sealing ring is arranged between the rear body and the front body, and the PCB board is embedded in the first sealing ring;

The second sealing ring is arranged between the box body and the rear body;

The third sealing ring is arranged between the power supply and the box body.

In the floor tile screen of the application, further comprising fixing mechanisms for fixing the box body, wherein the fixing mechanisms are arranged at the bottom of the box body.

BENEFICIAL EFFECTS

In the floor tile screen provided by the application, the fixing column has the function of limiting the front body, the front body and the rear body are connected together by fixing columns, to avoid separation of the front body and the rear body; and the fixing columns are transparent, so that the light emitted by the lamp beads is not blocked, and the display effect of the floor tile screen is improved.

Figure 1:
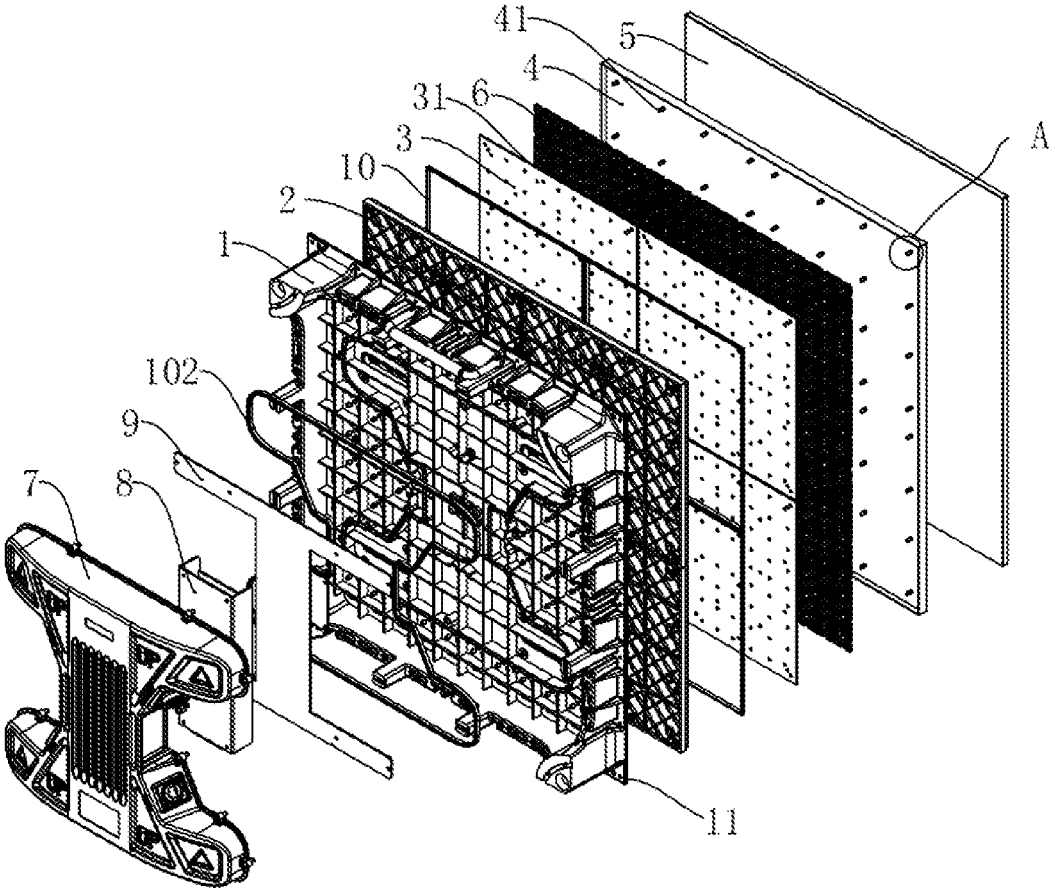
FIG. 1 is a schematic exploded view of the structure of the floor tile screen provided by an embodiment of the present application.

Reference numeral in the description are as follows:

1. Box body;
2. Rear body;
3. PCB board;
4. Front body;
5. Board;
6. Cover plate;
7. Rear cover;
8. Power supply;
9. Adapter plate;
10. First sealing ring;
11. Fixing mechanism;
21. Support column;
31. Fixing pieces;
41. Fixing column;
42. Limit block;
101. Second sealing ring;
102. Third sealing ring;
103. Positioning column

EMBODIMENTS OF THE PRESENT APPLICATION

In order to make the technical problem to be solved, technical solutions and beneficial effects of this application clearer, the application will be described in further detail below with reference to the drawings and embodiments. It should be understood that the specific embodiments described herein are only for the purpose of illustration only and are not intended to limit the scope of the application.

It should be noted that when an element is referred to as being "fixed" or "arranged" on another element, it can be directly on the other element or indirectly on the other element. When an element is referred to as being "connected" to another element, it may be directly connected to the other element or indirectly connected to the other element.

It is to be understood that the terms "length", "width", "upper", "lower", "front", "rear", "left", "right", "vertical", "horizontal", "top", "bottom", "inner", "outer" and the like indicate the orientation or positional relationship based on the orientation or positional relationship shown in the drawings, only for convenience of describing the application and simplifying the description, and do not indicate or imply that the said device or element must have a specific orientation, or be constructed and operated in a specific orientation, and therefore cannot be understood as a limitation to the application.

Furthermore, the terms "first" and "second" are used for descriptive purposes only and cannot be understood as indicating or implying relative importance or implicitly indicating the number of the technical features. Thus, a feature defining "first" and "second" may explicitly or implicitly include one or more of the features. In the description of this application, the meaning of "a plurality of" is two or more, unless specifically defined otherwise.

Figure 2:
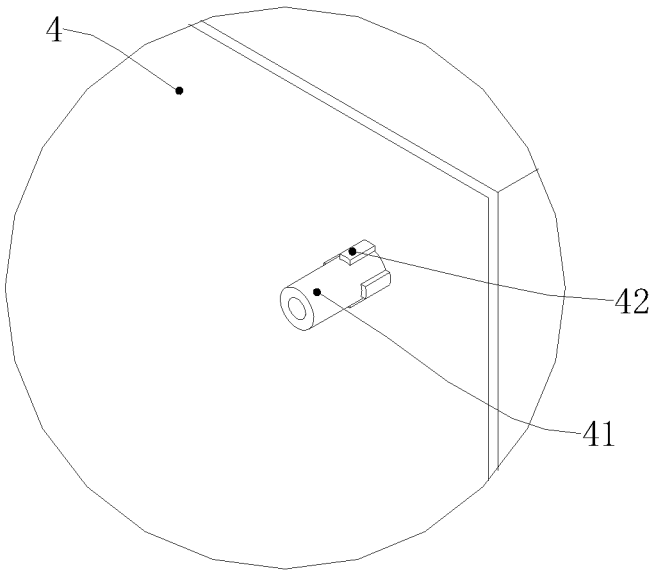
FIG. 2 is an enlarged view of A in FIG. 1.

Referring to FIGS. 1 and 2, the floor tile screen provided by the embodiment of the present application comprises a box body 1, a rear body 2, a PCB board 3 and a front body 4, wherein the rear body 2 is fixed on the box body 1, the PCB board 3 is arranged between the rear body 2 and the front body 4, the PCB board 3 is provided with lamp beads, a plurality of transparent fixing columns 41 are fixedly arranged on the front body 4, the fixing columns 41 pass through the PCB board 3 and are fixedly connected with the rear body 2, and the fixing columns 41 avoid the lamp beads.

The floor tile screen provided by the application, the fixing column 41 has the function of limiting the front body 4, the front body 4 and the rear body 2 are connected together by fixing columns 41, to avoid separation of the front body 4 and the rear body 2; and the fixing columns 41 are transparent, so that the light emitted by the lamp beads is not blocked, and the display effect of the floor tile screen is improved.

Specifically, the PCB board 3 is provided with through holes through which the fixing columns 41 pass.

In one embodiment, the fixing columns 41 are integrally formed with the front body 4 to facilitate fixing the fixing columns 41 to the front body 4.

Specifically, the rear body 2 is fixed to the box body 1 by screws.

In one embodiment, referring to FIG. 2, one end of each of the plurality of fixing columns 41 close to the front body is fixedly provided with limit blocks 42, the length of each of the plurality of limit blocks 42 from one end close to the front body 4 to one end far away from the front body 4 is the same, and the limit blocks 42 can abut against the PCB board 3 or the rear body 2. the limit blocks 42 have the function of supporting the front body 4, and can transmit the pressure received by the front body 4 to the PCB board 3 or the rear body 2 through the limit blocks 42 to prevent the front body 4 from crushing the PCB board 3.

Specifically, the length of the limiting block 42 is selected according to actual needs. If the limit blocks 42 abut against the side of the rear body 2 facing away from the box body 1, the limit blocks 42 are longer; If the limit blocks 42 abut against the PCB board 3, the limit blocks 42 are shorter.

Preferably, each fixing column 41 is provided with limit blocks 42.

Preferably, referring to FIG. 2, each fixing column 41 is provided with a plurality of limit blocks 42, and the plurality of limit blocks 42 are arranged at intervals along the circumferential direction of the fixing column 41, so that the shading thickness of the fixing column 41 is reduced, the display effect of the floor tile screen is improved, the weight of the front body 4 is reduced, and the material is economized.

In one embodiment, referring to FIG. 1, a plurality of fixing columns 41 passing through the PCB board 3 are uniformly distributed on the PCB board 3 to ensure the force uniformity between the front body 4 and the rear body 2, and at the same time to ensure that the positioning of the fixing columns 41 on the PCB board 3 is more stable and to prevent the PCB board 3 from moving when the floor tile screen is used.

In one embodiment, referring to FIG. 1, the PCB board 3 includes a plurality of fixedly connected sub-boards, to facilitate manufacturing, handling, installing and maintaining the sub-boards.

Preferably, the number of the fixing columns 41 passing through each sub-board is the same and they are evenly distributed.

Preferably, each floor tile screen is formed by splicing four sub-boards.

Alternatively, the tile screens can be spliced into a larger tile screen group.

Figure 3:
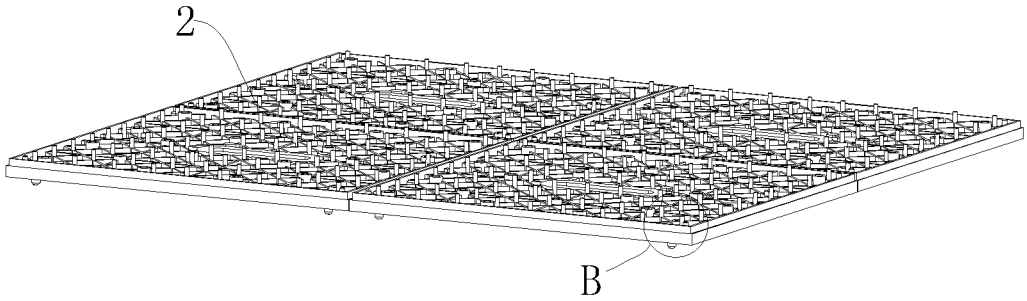
FIG. 3 is a schematic structural view of the rear body in FIG. 1.
Figure 4:
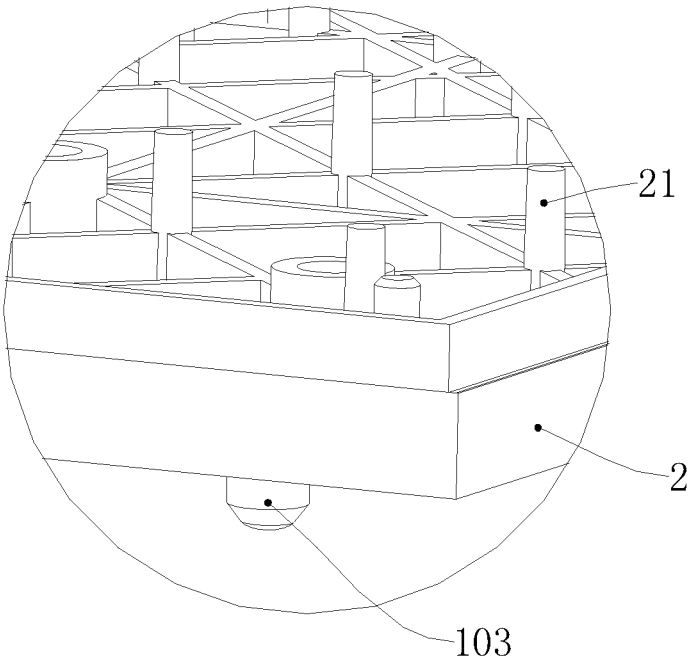
FIG. 4 is a schematic structural view of B in FIG. 3.

In one embodiment, referring to FIGS. 3 and 4, the rear body 2 is fixedly provided with a plurality of transparent support columns 21, the support columns 21 pass through the PCB board 3 and abut against the front body 4, the support columns 21 avoid the fixing columns 41, the support columns 21 can support the front body 4, transmit the pressure received from the front body 4 to the rear body 2, prevent the front body 4 from being excessively stressed and crushing the PCB board 3, and the transparent support columns 21 will not block out light, thus improving the display effect of the floor tile screen.

Specifically, the PCB board 3 is provided with through holes through which the fixing columns 21 pass.

Alternatively, the support columns 21 are integrally formed with the rear body 2.

Specifically, the limit blocks 42 and the support columns 21 support the front body 4 together to prevent the front body 4 from crushing the PCB 3 and increase the stress strength of the front body 4.

In one embodiment, referring to FIG. 1, it further includes a transparent board 5, which is fixed on the side of the front body 4 facing away from the PCB 3, the transparent board 5 has an anti-skid effect and does not affect the normal display effect of the floor tile screen. The board 5 also protects the front body 4 to prevent the front body 4 from being damaged due to stress concentration.

Preferably, the board 5 is transparent glass.

Preferably, the board 5 is tempered glass with good wear resistance.

In one embodiment, the board 5 is bonded to the front body 4, so that light can directly pass through front body 4 and board 5 to reach outside, thereby improving the display effect of the floor tile screen.

In one embodiment, referring to FIG. 1, it further includes a cover plate 6, the cover plate 6 is arranged between the front body 4 and the PCB board 3, the cover plate 6 is provided with a plurality of receiving holes, and lamp beads are embedded in the receiving holes;

The cover plate 6 is also provided with a plurality of through holes through which the fixing columns 41 pass. The cover plate 6 is used to protect the lamp bead and prevent the front body 4 from crushing the lamp bead. The cover plate 6 also has the function of limiting the lamp beads to prevent the lamp beads from falling off the PCB 3 when encountering accidents such as bumps and the like.

Specifically, the PCB board 6 is provided with through holes through which the support columns 21 pass.

Preferably, the front body 4, cover plate 6 and rear body 2 are all made of PC.

In one embodiment, referring to FIG. 1, it further includes fixing pieces 31, the rear body 2 is provided with mounting holes, the fixing columns 41 pass through the mounting holes, and the fixing pieces 31 fix the fixing columns 41 on the rear body 2, the fixing pieces 31 are arranged on the back of the PCB 3, and the light from the lamp beads is emitted from the front surface of the PCB 3, so the fixing pieces 31 will not block out light emitted by the lamp beads, thereby improving the display effect of the floor tile screen.

In one embodiment, referring to FIGS. 1 and 2, the fixing columns 41 are provided with fixing holes, and the fixing pieces 31 can extend into the fixing holes and abut against the inner wall of the fixing holes, so that the fixing columns 41 are fixed to the rear body 2 by the fixing pieces 31 through friction between the fixing pieces 31 and the inner wall of the fixing holes.

Specifically, the fixing hole extends in the axial direction of the fixing column 41.

Preferably, referring to FIG. 2, the fixing pieces 31 are screws, the fixing holes are threaded holes, and the fixing columns 41 are fixed to the rear body 2 by screws.

In one embodiment, referring to FIG. 4, the rear body 2 is fixedly provided with positioning columns 103, the box body 1 is provided with positioning holes, the positioning columns 103 can extend into the positioning holes to prevent the rear body 2 from moving when the floor tile screen is used, and when the rear body 2 is installed on the box body 1, the positioning columns 103 can be inserted into the positioning holes first, and the rear body 2 can be fixed after being positioned on the box body 1, so that the structure is simple and the operation is convenient.

In one embodiment, referring to FIG. 1, it further includes a rear cover 7, a power supply 8, and an adapter plate 9, wherein the rear cover 7 is fixed on one side of the box body 1 facing away from the rear body 2, the power supply 8 is arranged in the rear cover 7, and the adapter plate 9 is fixed in the rear cover 7 and positioned between the power supply 8 and the box body 1, the rear cover 7 is used for fixing and protecting the power supply 8 and the adapter plate 9, the power supply 8 is used for supplying power to the PCB board 3, and the adapter plate 9 is used for converting or transmitting signals.

Figure 5:
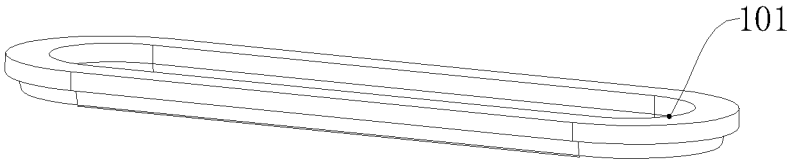
FIG. 5 is a schematic structural view of the second sealing ring provided in an embodiment of the present application.

In one embodiment, referring to FIGS. 1 and 5, it further includes a first sealing ring 10, a second sealing ring 101 and a third sealing ring 102, wherein the first sealing ring 10 is arranged between the rear body 2 and the front body 4, the PCB board 3 is embedded in the first sealing ring 10, and the first sealing ring 10 can prevent water from entering from the side surface of the PCB board 3 and avoid short-circuit of the PCB board 3;

The second sealing ring 101 is arranged between the box body 1 and the rear body 2. The second sealing ring 101 can prevent water from entering between the box body 1 and the rear body 2, and prevent the PCB board 3 from being short-circuited.

The third sealing ring 102 is arranged between the power supply 8 and the box body 1. The third sealing ring 102 can prevent water from entering the rear cover 7 from between the rear cover 7 and the box body 1, and then entering from the side surface of the adapter plate 9, thus avoiding the short circuit of the PCB plate 3.

Specifically, the number of first sealing ring 10 is plural, the number of second sealing ring 101 is plural, and the number of third sealing ring 102 is one.

Preferably, the number of first sealing ring 10 is set to four, the number of second sealing ring 101 is set to four.

In one embodiment, referring to FIG. 1, it further includes fixing mechanisms 11 for fixing the box body 1, wherein the fixing mechanisms 11 are arranged at the bottom of the box body 1, so as to fix the box body 1 on the ground when in use, and prevent the gap between the floor tile screens from being too large due to the displacement of the box body 1, which could affect the display effect.

The above descriptions are only preferred embodiments of the present application, and are not intended to limit the application. Any modification, equivalent substitution and improvement made within the spirit and principles of the application shall be included in the scope of protection of the application.

What is claimed is:

1. A floor tile screen, comprising a box body, a rear body, a PCB board and a front body, wherein the rear body is fixed on the box body, the PCB board is arranged between the rear body and the front body, the PCB board is provided with lamp beads, the floor tile screen is characterized in that a plurality of transparent fixing columns are fixedly arranged on the front body, the fixing columns pass through the PCB board and are fixedly connected with the rear body, and the fixing columns avoid the lamp beads.

2. The floor tile screen according to claim 1, wherein the fixing columns are integrally formed with the front body.

3. The floor tile screen according to claim 1, wherein one end of each of the plurality of fixing columns close to the front body is fixedly provided with limit blocks, the length of each of the plurality of limit blocks from one end close to the front body to one end far away from the front body is the same, and the limit blocks can abut against the PCB board or the rear body.

4. The floor tile screen according to claim 3, wherein each fixing column is provided with a plurality of limit blocks, and the plurality of limit blocks are arranged at intervals along the circumferential direction of the fixing column.

5. The floor tile screen according to claim 1, wherein a plurality of the fixing columns passing through the PCB board are uniformly distributed on the PCB board.

6. The floor tile screen according to claim 1, wherein a plurality of transparent support columns are fixedly arranged on the rear body, the support columns pass through the PCB board and abut against the front body, and the support columns avoid the fixing columns.

7. The floor tile screen according to claim 1, further comprising a transparent board, wherein the board is fixed on the side of the front body facing away from the PCB board.

8. The floor tile screen according to claim 7, wherein the transparent board is bonded to the front body.

9. The floor tile screen according to claim 1, further comprising a cover plate, wherein the cover plate is arranged between the front body and the PCB board, the cover plate is provided with a plurality of receiving holes, and the lamp beads are embedded in the receiving holes;

the cover plate is further provided with a plurality of through holes through which the fixing columns pass.

10. The floor tile screen according to claim 1, further comprising fixing pieces, wherein the rear body is provided with mounting holes, the fixing columns pass through the mounting holes, and the fixing pieces fix the fixing columns on the rear body.

11. The floor tile screen according to claim 10, wherein the fixing columns are provided with fixing holes, and the fixing pieces can extend into the fixing holes and abut against the inner wall of the fixing holes.

12. The floor tile screen according to claim 1, wherein positioning columns are fixedly arranged on the rear body, positioning holes are arranged on the box body, and the positioning columns can extend into the positioning holes.

13. The floor tile screen according to claim 1, further comprising a rear cover, a power supply and an adapter plate, wherein the rear cover is fixed on one side of the box body facing away from the rear body, the power supply is arranged in the rear cover, and the adapter plate is fixed in the rear cover and positioned between the power supply and the box body.

14. The floor tile screen according to claim 13, further comprising a first sealing ring, a second sealing ring and a third sealing ring, wherein the first sealing ring is arranged between the rear body and the front body, and the PCB board is embedded in the first sealing ring;

the second sealing ring is arranged between the box body and the rear body;

the third sealing ring is arranged between the power supply and the box body.

15. The floor tile screen according to claim 1, further comprising fixing mechanisms for fixing the box body, wherein the fixing mechanisms are arranged at the bottom of the box body.

* * * * *